United States Patent [19]

Brüstle et al.

[11] 4,386,449

[45] Jun. 7, 1983

[54] ADJUSTABLE FURNITURE HINGE

[76] Inventors: Klaus Brüstle, Fellentorstr. 23, Lauterach, Austria, A-6923; Erich Röck, Küferstr. 7, Höchst, Austria, A-6973

[21] Appl. No.: 276,633

[22] Filed: Jun. 23, 1981

[30] Foreign Application Priority Data

Jul. 4, 1980 [AT] Austria ..... 3491/80

[51] Int. Cl.[3] ..... D05B 15/16

[52] U.S. Cl. ..... 16/238; 16/379

[58] Field of Search ..... 16/271, 379, 238, 370, 16/366, 245

[56] References Cited

U.S. PATENT DOCUMENTS 4,011,627 3/1977 Salice ..... 16/238

4,176,424 12/1979 Rock et al. ..... 16/379 X

FOREIGN PATENT DOCUMENTS 2634558 2/1978 Fed. Rep. of Germany ..... 16/333

2721951 11/1978 Fed. Rep. of Germany ..... 16/245

*Primary Examiner*—Werner H. Schroeder

*Assistant Examiner*—Andrew M. Falik

*Attorney, Agent, or Firm*—Wenderoth, Lind & Ponack

[57] ABSTRACT

A furniture hinge includes a mounting member that is fixable on a frame of a cabinet and a hinge casing that is insertable into a bore in a door of the cabinet. A hinge arm is linked to the hinge casing by means of hinge links. The hinge arm is mounted on the mounting member by means of an intermediate member and is held on this intermediate member by a screw. The position of the hinge arm is adjustable with respect to the mounting member.

4 Claims, 7 Drawing Figures

ADJUSTABLE FURNITURE HINGE

BACKGROUND OF THE INVENTION

1. Field of the Invention

The present invention relates to a hinge for adjustably connecting a door with a member of a door frame, and includes a hinge casing insertable into the door, the hinge casing being linked to a hinge arm, which is on the side of the frame, by means of hinge links. The hinge arm for example can be fastened to the frame by means of a mounting housing insertable into a recess of the frame member.

2. Description of the Prior Art

So-called door frames are frequently used in modern furniture construction, whereby such frames, which are stable parts, carry the hinges for the door, and the actual side walls of the body of the piece of furniture are made of a less strong material. This new kind of furniture construction creates new problems with respect to the mounting of the hinges, as the mounting plates of conventional hinges are too long to be fastened to the frame of the door. It is no longer possible to fasten the hinges to the side walls of pieces of furniture, as they are not able to carry the load of the door because of their weaker structure.

SUMMARY OF THE INVENTION

It is, therefore, the object of this invention to provide a hinge which makes it possible to fasten the hinge arm to the frame of a door, whereby the space required for the hinge in the direction of the depth of the piece of furniture is as small as possible. It should, however, also be possible to adjust the hinge.

According to the invention, this is achieved by an intermediate member which is inserted into the mounting housing and keeps the hinge arm retained in or on the mounting housing by means of a fastening screw mounted in a female thread in the intermediate member. The intermediate member and the hinge arm are adapted to be inserted into the mounting housing in the direction of the breadth of the door joint. The intermediate member has lateral flanges, for example, extending into grooves of the mounting housing. A clamping screw mounted in the mounting housing in the region of the grooves presses on a flange of the intermediate member and clamps the intermediate member in a fixed position.

The intermediate member is inserted into the mounting housing from the side of the frame parallel to the closing plane of the door and may obviously within a certain range be clamped into the mounting housing in any position by means of the clamping screw, whereby an adjustment in the direction of the breadth of the door joint is obtained.

It is preferably provided that the intermediate member is insertable into the mounting housing and the hinge arm into the intermediate member.

Hence, the mounting parts of the hinge may be almost completely inserted into the frame member. The parts project only slightly beyond the frame member and fit closely with the inner rim surface of the frame.

Further, an adjusting screw mounted in a flange of the intermediate member may preferably be provided, such screw being aligned in the direction of the door joint and abutting against the inner wall of the mounting housing.

It is the main task of this adjusting screw to provide a zero position so that mounting operations can be easily carried out. Because of the zero position provided by the adjusting screw, which position is defined by the extent to which the adjusting screw projects from the intermediate member in the direction of the mounting housing, the intermediate member onto which the hinge arm is screwed and which is linked to the hinge casing on the side of the door by means of the hinge links can, when the door is being mounted, be quickly inserted into the mounting housing and fixed by means of the clamping screw. The position of the intermediate member and of the hinge arm in the direction of the breadth of the door joint is set by the stop of the adjusting screw. Only if an adjustment of the hinge arm and of the intermediate member is required, and the intermediate member has to be further inserted into the mounting housing, does the adjusting screw have to be turned.

In order to ensure a height adjustment of the hinge, a further embodiment provides that the fastening screw extends through a slot or slots in the hinge arm, such slot or slots extending in the direction of the height of the piece of furniture so that the hinge arm is displaceable in the direction of the height within the intermediate member.

BRIEF DESCRIPTION OF THE DRAWINGS

In the following two embodiments the invention will be described in more detail with reference to the drawings without being limited thereto, and in which.

DESCRIPTION OF THE PREFERRED EMBODIMENTS

Figure 7:
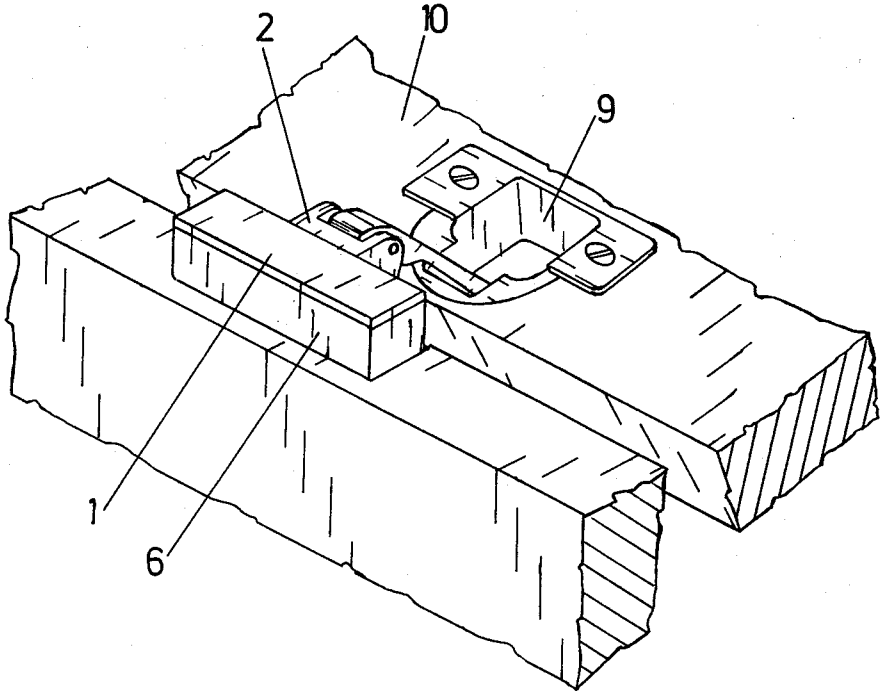
FIG. 7 is a three-dimensional view of the hinge according to the invention.

The hinge according to the invention substantially comprises the following parts: a hinge casing 9, which is insertable into a bore of a door 10, a hinge arm 2, which is linked to the hinge casing 9 by means of hinge links, shown in FIG. 7, an intermediate member 4, which is retained on the hinge arm 2 by means of a fastening screw 3, and a mounting housing 6.

The mounting housing 6 is inserted into a recess 11 in a frame member 12, the recess 11 being of semicircular configuration.

The mounting housing 6 has at its front side flanges 13 which are provided with holes 14. Screws 8 attach the mounting housing 6 to the frame member 12 through the holes 14.

Figure 1:
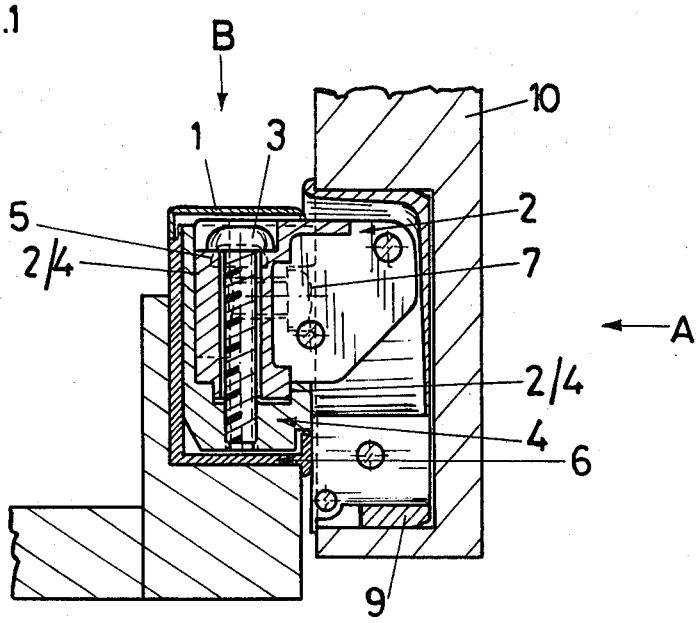
FIG. 1 is a horizontal sectional view of a hinge according to the invention in the closed position.
Figure 2:
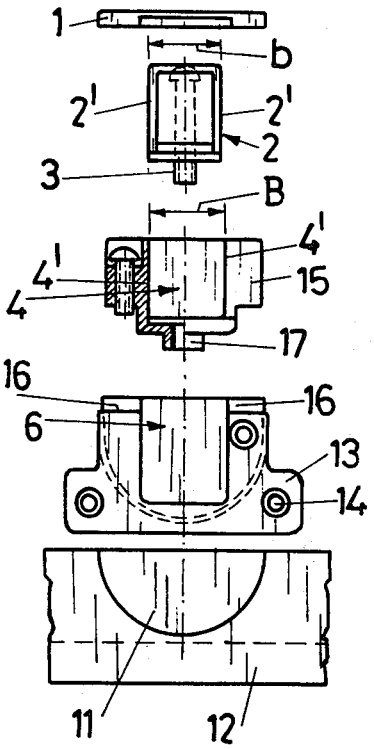
FIG. 2 is a view from the direction of arrow A of FIG. 1 of the hinge parts on the side of the frame, the hinge parts being in the disassembled position.
Figure 3:
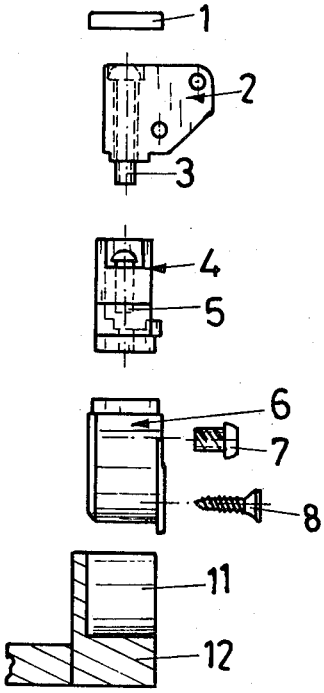
FIG. 3 is a view similar to FIG. 2, the parts being turned by 90°.
Figure 4:
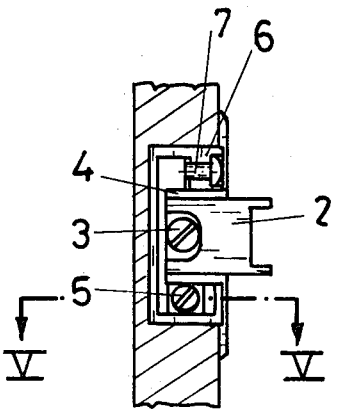
FIG. 4 is a view of the hinge parts on the side of the frame from the direction of arrow B of FIG. 1.

In the view from the direction of arrow B in FIG. 1, the mounting housing 6 is substantially C-shaped.

The intermediate member 4 is insertable into the mounting housing 6 from such direction and is provided with lateral flanges 15 extending into lateral grooves 16 of the mounting housing 6.

In the region of at least one groove 16, a clamping screw 7 is provided in the mounting housing 6.

When the intermediate member 4 has been inserted into the mounting housing 6 and is in the desired position, the clamping screw 7 is fastened, and the intermediate member 4 is thereby clamped into the mounting housing 6.

The hinge arm 2 is fastened in the intermediate member 4, i.e. it is retained in the intermediate member 4, by means of fastening screw 3 mounted in a female thread 17 of the intermediate member 4. A cover plate 1 provides an improved appearance.

In the embodiment according to FIGS. 2 through 5, an adjusting screw 5 is provided in one flange 15 of the intermediate member 4.

Figure 5:
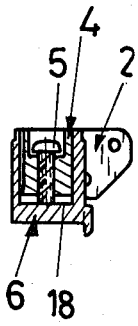
FIG. 5 is a sectional view along line V—V of FIG. 4.

As can be seen in FIG. 5, the adjusting screw 5 abuts with its front end against an inner wall 18 of the mounting housing 6. Thereby, depending on the extent to which the adjusting screw 5 projects, a preset positioning of the intermediate member 4 with respect of the mounting housing 6 is obtained.

In order to ensure a height adjustment of the hinge, it may be provided that the fastening screw 3 extends through a slot or slots in the hinge arm 2, such slots being aligned in the direction of the height of the piece of furniture.

If, further, the breadth B between the inner walls 4' of the intermediate member 4 is greater than the breadth b between the outer walls 2' of the hinge arm 2, the direction of the hinge arm 2 is displaceable in the height of the piece of furniture.

As can be seen in FIG. 1, the hinge arm 2 and the intermediate member 4 are provided with rear and preferably with one front guide surfaces 2/4, whereby a tilting of the hinge arm 2 under the load of the door 10 is prevented. An alignment of the hinge arm 2 is also obtained by the arrangement of two hinges on each door 10.

Figure 6:
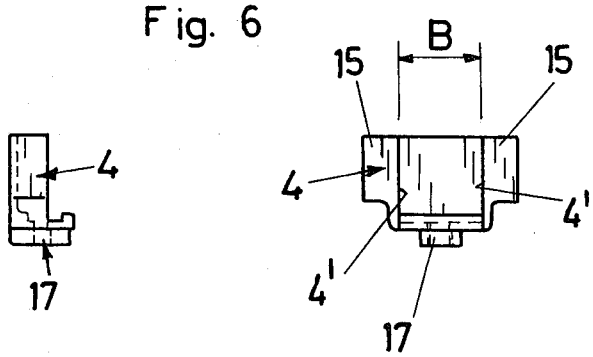
FIG. 6 shows two views normal to each other of a simplified embodiment of an intermediate member.

In the embodiment according to FIG. 6, an intermediate member 4 of a simplified design has been illustrated in which a separate adjusting screw for the adjustment of the joint and for the setting of the zero position is not provided.

What is claimed is:

1. A hinge for adjustably connecting a door with a member of a door frame, said hinge comprising:

a hinge casing adapted to be connected to a door;

a mounting housing adapted to be fixedly inserted into a recess in a door frame member, said mounting housing having therein grooves;

an intermediate member having lateral flanges, said intermediate member being insertable into said mounting housing in the direction of the breadth of the door joint with said lateral flanges extending into said grooves;

clamping screw means, provided in said mounting housing in the area of one of said grooves, for pressing against one of said lateral flanges, thereby clamping said intermediate member in a fixed position in said mounting housing;

a hinge arm connected to said hinge casing by means of hinge links;

fastening screw means, threaded into said intermediate member, for connecting said hinge arm to said intermediate member; and means for enabling adjustment of the position of said hinge arm with respect to said intermediate member in the direction of the height of the door.

2. A hinge as claimed in claim 1, wherein said adjustment means comprises at least one slot in said hinge arm, said fastening screw means extending through said slot.

3. A hinge as claimed in claim 1, wherein said hinge arm fits within said intermediate member, and the dimension, in the direction of the height of the door, between the inner walls of said intermediate member being greater than the dimension, in the direction of the height of the door, between the outer walls of said hinge arm.

4. A hinge as claimed in claim 1, further comprising an adjusting screw mounted in one of said lateral flanges, said adjusting screw extending in the direction of the door joint and abutting against an inner wall of said mounting housing.

* * * * *